US009562727B2

(12) United States Patent
Fujii et al.

(10) Patent No.: US 9,562,727 B2
(45) Date of Patent: Feb. 7, 2017

(54) HEAT EXCHANGER WITH VARIABLE TUBE LENGTH

(71) Applicant: KEIHIN THERMAL TECHNOLOGY CORPORATION, Oyama-shi, Tochigi (JP)

(72) Inventors: Takayuki Fujii, Oyama (JP); Yoshihiko Seno, Oyama (JP); Shingo Suzuki, Oyama (JP)

(73) Assignee: KEIHIN THERMAL TECHNOLOGY CORPORATION, Oyama-Shi (JP)

( * ) Notice: Subject to any disclaimer, the term of this patent is extended or adjusted under 35 U.S.C. 154(b) by 197 days.

(21) Appl. No.: 13/770,964

(22) Filed: Feb. 19, 2013

(65) Prior Publication Data

US 2013/0213624 A1 Aug. 22, 2013

(30) Foreign Application Priority Data

Feb. 20, 2012 (JP) ..... 2012-034049

(51) Int. Cl.

| | |
|---|---|
| ***F28F 1/10*** | (2006.01) |
| ***F28F 1/12*** | (2006.01) |
| ***F28D 1/053*** | (2006.01) |
| *F25B 39/04* | (2006.01) |

(52) U.S. Cl.

CPC ..... *F28F 1/10* (2013.01); *F28D 1/05375* (2013.01); *F28F 1/126* (2013.01); *F25B 39/04* (2013.01); *F25B 2339/0444* (2013.01); *F28F 2215/04* (2013.01)

(58) Field of Classification Search

CPC ..... F25B 39/04; F25B 40/02; F25B 2339/044; F25B 2339/0444; F25B 2339/0446; F28D 1/05375; F28D 2021/0084; F28F 2215/04; F28F 1/10; F28F 1/126

USPC ..... 165/148, 149, 150, 151, 153, 172, 174, 165/175, 176; 62/509

See application file for complete search history.

(56) References Cited

U.S. PATENT DOCUMENTS

| | | | | |
|---|---|---|---|---|
| 5,095,972 A * | 3/1992 | Nakaguro | ..... | 165/153 |
| 5,190,100 A * | 3/1993 | Hoshino et al. | ..... | 165/146 |
| 5,546,761 A * | 8/1996 | Matsuo et al. | ..... | 62/509 |
| 5,743,328 A * | 4/1998 | Sasaki | ..... | F28D 1/0417 165/144 |
| 7,040,386 B2 * | 5/2006 | Shimoya | ..... | F28F 1/022 165/153 |

(Continued)

FOREIGN PATENT DOCUMENTS

WO WO 2010/047320 4/2010

*Primary Examiner* — Len Tran
*Assistant Examiner* — Hans Weiland
(74) *Attorney, Agent, or Firm* — Mori & Ward, LLP

(57) ABSTRACT

A heat exchanger includes a plurality of heat exchange tubes and corrugated fins. The heat exchange tubes are spaced apart from one another in a vertical direction of the heat exchanger. The corrugated fins are each disposed between adjacent heat exchange tubes. Each of the corrugated fins includes crest portions, trough portions, and connection portions. The crest portions extend in an air passage direction of the heat exchanger. The trough portions extend in the air passage direction. The connection portions connect the crest portions and the trough portions. The number of the crest portions of each of the corrugated fins disposed between adjacent heat exchange tubes falls within a range of a designed number ±2. The designed number is a standard number.

3 Claims, 5 Drawing Sheets

(56) References Cited

U.S. PATENT DOCUMENTS

| | | | | |
|---|---|---|---|---|
| 2003/0217567 | A1* | 11/2003 | Oh et al. | 62/509 |
| 2006/0102329 | A1* | 5/2006 | Taras | F25B 39/02 165/146 |
| 2009/0100854 | A1* | 4/2009 | Reyzin | F25B 39/04 62/305 |
| 2011/0186277 | A1* | 8/2011 | Hanafusa | 165/173 |

* cited by examiner

HEAT EXCHANGER WITH VARIABLE TUBE LENGTH

CROSS-REFERENCE TO RELATED APPLICATIONS

The present application claims priority under 35 U.S.C. §119 to Japanese Patent Application No. 2012-034049, filed Feb. 20, 2012. The contents of this application are incorporated herein by reference in their entirety.

BACKGROUND OF THE INVENTION

Field of the Invention

The present invention relates to a heat exchanger.

Discussion of the Background

For example, a condenser of a car air conditioner has been demanded to be further improved in refrigerant condensation efficiency and refrigerant subcooling efficiency. In order to meet such a demand, the applicant of the present application has proposed an improved condenser (see the pamphlet of WO2010/047320). The proposed condenser has a condensation section and a subcooling section provided such that the condensation section is located on the upper side. The condenser includes a plurality of heat exchange tubes, corrugated fins, and header tanks. The heat exchange tubes are disposed in parallel such that their longitudinal direction coincides with the left-right direction and they are spaced apart from one another in the vertical direction. Each of the corrugated fins has crest portions extending in an air-passing direction, trough portions extending in the air-passing direction, and connection portions connecting the crest portions and the trough portions. Each of the corrugated fins is disposed between adjacent heat exchange tubes. The header tanks are disposed such that their longitudinal direction coincides with the vertical direction, and left and right end portions of the heat exchange tubes are connected to the corresponding header tanks. Three heat exchange paths each composed of a plurality of heat exchange tubes successively arranged in the vertical direction are juxtaposed in the vertical direction. The condenser has a first tube group composed of the heat exchange path at the upper end, and a second tube group provided below the first tube group and composed of the remaining heat exchange paths. The heat exchange tubes of the second tube group are greater in length than the heat exchange tubes of the first tube group. The header tanks include a first header tank and a second header tank provided at the left end or right end. The heat exchange tubes which form the heat exchange path of the first tube group are connected to the first header tank, and the heat exchange tubes which form the heat exchange paths of the second tube group are connected to the second header tank. The second header tank is disposed on the outer side of the first header tank with respect to the left-right direction, and the upper end of the second header tank is located above the lower end of the first header tank. Refrigerant is caused to flow through the heat exchange paths of the second tube group after flowing through the heat exchange path of the first tube group. The second header tank has a function of separating gas and liquid from each other and storing the separated liquid. The heat exchange path of the first tube group and the upper end heat exchange path of the second tube group serve as refrigerant condensation paths present in the condensation section, and the remaining heat exchange path of the second tube group serves as a refrigerant subcooling path present in the subcooling section.

In the condenser disclosed in the pamphlet, the length of the heat exchange tubes of the lower end refrigerant condensation path of the second tube group and the length of the heat exchange tubes of the refrigerant subcooling path of the second tube group can be rendered greater than the length of the heat exchange tubes of the first tube group. Therefore, the areas of the heat exchange sections of the condensation section and the subcooling section increase. As a result, the refrigerant condensation efficiency and the refrigerant subcooling efficiency can be improved further.

SUMMARY OF THE INVENTION

According to one aspect of the present invention, a heat exchanger includes a plurality of heat exchange tubes and corrugated fins. The plurality of heat exchange tubes differ in length and are disposed such that a longitudinal direction of each of the heat exchange tubes coincides with a left-right direction of the heat exchanger. The heat exchange tubes are spaced apart from one another in a vertical direction of the heat exchanger. The corrugated fins are each disposed between adjacent heat exchange tubes. Each of the corrugated fins includes crest portions, trough portions, and connection portions. The crest portions extend in an air passage direction of the heat exchanger. The trough portions extend in the air passage direction. The connection portions connect the crest portions and the trough portions. The number of the crest portions of each of the corrugated fins disposed between adjacent heat exchange tubes falls within a range of a designed number ±2. The designed number is a standard number.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
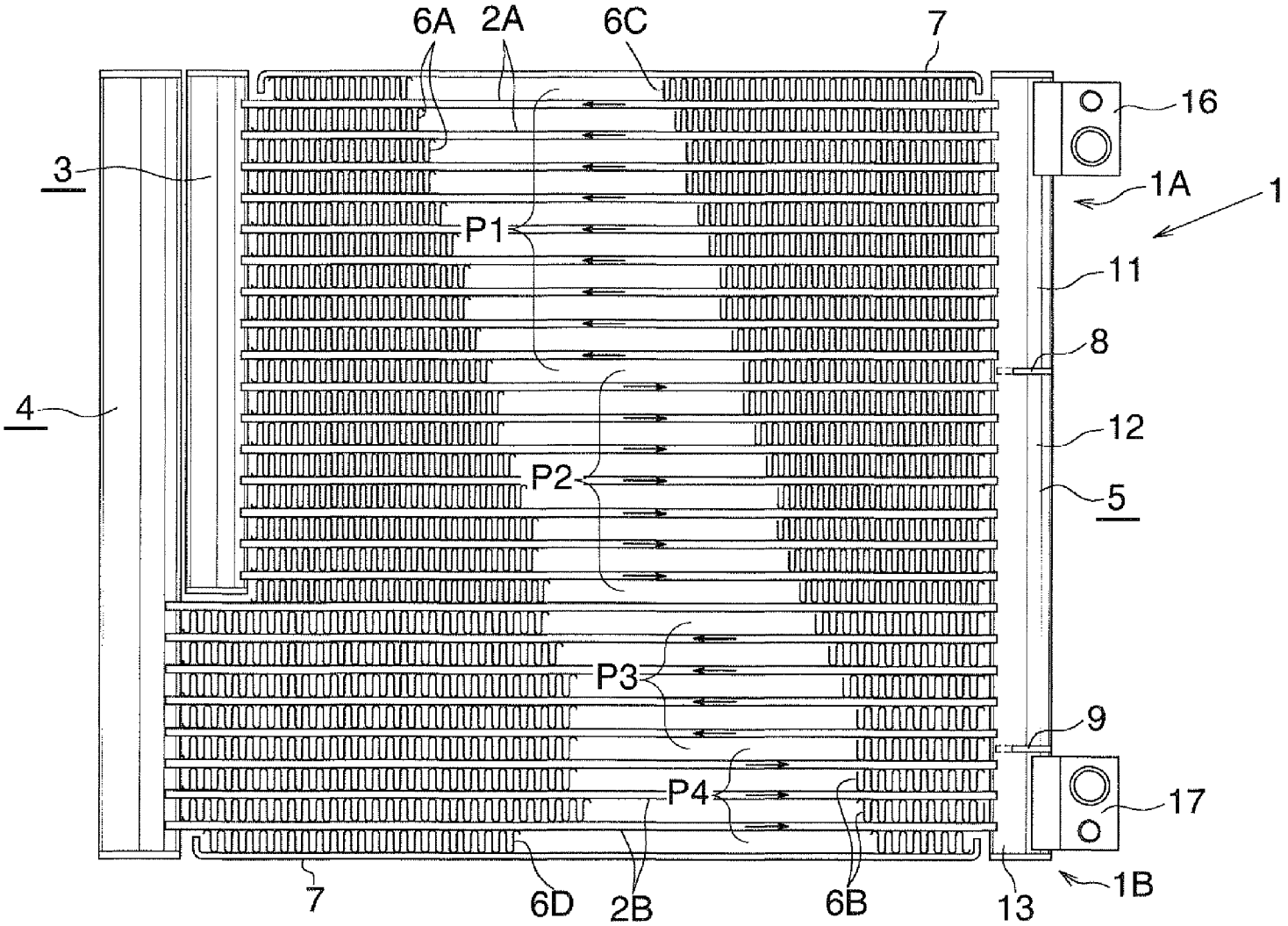
FIG. 1 is a front view specifically showing the overall structure of a condenser to which a heat exchanger according to a first embodiment is applied.

The embodiments will now be described with reference to the accompanying drawings, wherein like reference numerals designate corresponding or identical elements throughout the various drawings.

In the first embodiment, a heat exchanger according to the first embodiment is applied to a condenser of a car air conditioner mounted on an automobile.

In the following description, the reverse side of a sheet on which FIG. 1 is drawn will be referred to as the "front," and the opposite side as the "rear." The upper side, lower side, left-hand side, and right-hand side of FIGS. 1 and 3 will be referred to as "upper," "lower," "left," and "right," respectively.

Furthermore, the term "aluminum" as used in the following description encompasses aluminum alloys in addition to pure aluminum. Also, the term "condenser" as used in the following description encompasses not only an ordinary condenser but also a subcooling condenser having a condensation section and a subcooling section.

Like portions and components are denoted by like reference numerals throughout the drawings, and they will not be described redundantly.

Figure 2:
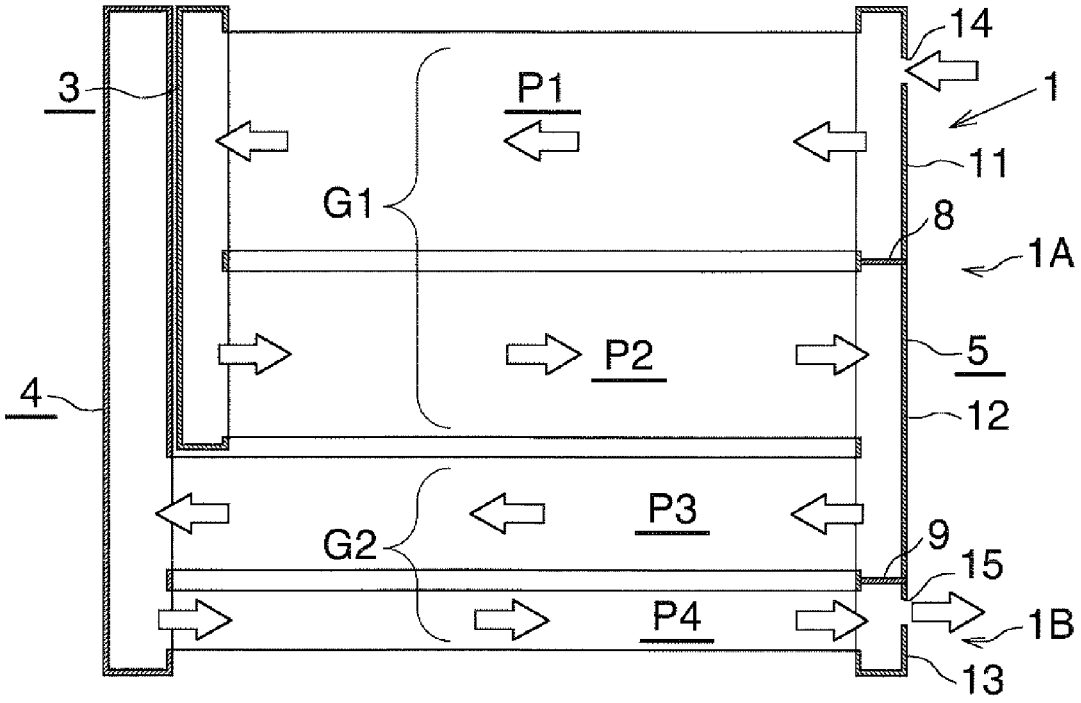
FIG. 2 is a front view schematically showing the condenser of FIG. 1.

FIG. 1 specifically shows the overall structure of the first embodiment of a condenser to which a heat exchanger according to the first embodiment is applied, and FIG. 2 schematically shows the condenser of FIG. 1. In FIG. 2, individual heat exchange tubes are not illustrated, and corrugated fins, side plates, a refrigerant inlet member, and a refrigerant outlet member are also not illustrated. FIGS. 3 to 6 show methods of disposing corrugated fins between adjacent heat exchange tubes.

As shown in FIGS. 1 and 2, a condenser 1 includes a plurality of flat heat exchange tubes 2A, 2B formed of aluminum, three header tanks 3, 4, 5 formed of aluminum, corrugated fins 6A, 6B, 6C, 6D formed of aluminum, and side plates 7 formed of aluminum. The heat exchange tubes 2A, 2B are disposed such that their width direction coincides with a front-rear direction, their longitudinal direction coincides with a left-right direction, and they are spaced apart from one another in a vertical direction. The header tanks 3, 4, 5 are disposed such that their longitudinal direction coincides with the vertical directions, and left and right end portions of the heat exchange tubes 2A, 2B are connected to the header tanks 3, 4, 5 by means of brazing. Each of the corrugated fins 6A is disposed between and brazed to adjacent heat exchange tubes 2A. Each of the corrugated fins 6B is disposed between and brazed to adjacent heat exchange tubes 2B. The corrugated fin 6C is disposed on the outer side of the uppermost exchange tube 2A and is brazed thereto. The corrugated fin 6D is disposed on the outer side of the lowermost exchange tube 2B and is brazed thereto. The side plates 7 are disposed on the corresponding outer sides of the uppermost and lowermost corrugated fins 6C, 6D, and are brazed to these corrugated fins 6C, 6D.

In the condenser 1, three or more heat exchange paths (in the present embodiment, four heat exchange paths P1, P2, P3, P4) each formed by a plurality of heat exchange tubes 2A, 2B successively arranged in the vertical direction are juxtaposed in the vertical direction. The four heat exchange paths will be referred to as the first through fourth heat exchange paths P1, P2, P3, P4 from the upper side. The flow direction of refrigerant is the same among all the heat exchange tubes 2A, 2B which form the respective heat exchange paths P1, P2, P3, P4. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path. The first and second heat exchange paths P1, P2 are formed by the heat exchange tubes 2A (hereinafter referred to as the first heat exchange tubes) of the same type which have the same length. The third and fourth heat exchange paths P3, P4 are formed by the heat exchange tubes 2B (hereinafter referred to as the second heat exchange tubes) of the same type which have the same length.

Namely, the condenser 1 has a first tube group G1 composed of at least one heat exchange path including the first heat exchange path P1 at the upper end (in the present embodiment, two heat exchange paths; i.e., the first and second heat exchange paths P1, P2), and a second tube group G2 provided below the first tube group G1 and composed of at least one heat exchange path including the fourth heat exchange path P4 at the lower end (in the present embodiment, two heat exchange paths; i.e., the third and fourth heat exchange paths P3, P4). The second heat exchange tubes 2B of the second tube group G2 is greater in length than the first heat exchange tubes 2A of the first tube group G1. In the first tube group G1, refrigerant is caused to flow from the first heat exchange path P1 at the upper end toward the second heat exchange path P2 at the lower end. In the second tube group G2, refrigerant is caused to flow from the third heat exchange path P3 at the upper end toward the fourth heat exchange path P4 at the lower end. The refrigerant having flowed through the two heat exchange paths P1, P2 of the first tube group G1 is caused to flow through the two heat exchange paths P3, P4 of the second tube group G2.

The first header tank 3 and the second header tank 4 are individually provided at the left end of the condenser 1. The first heat exchange tubes 2A of the first and second heat exchange paths P1, P2 of the first tube group G1 are connected to the first header tank 3 by means of brazing. The second heat exchange tubes 2B of the third and fourth heat exchange paths P3, P4 of the second tube group G2 are connected to the second header tank 4 by means of brazing. The second header tank 4 is disposed on the outer side (left side) of the first header tank 3 with respect to the left-right direction.

The upper end of the second header tank 4 is located above the lower end of the first header tank 3. In the present embodiment, the upper end of the second header tank 4 is located at a position which is substantially the same height as the upper end of the first header tank 3. The lower end of the second header tank 4 is located below the lower end of the first header tank 3. The second heat exchange tubes 2B of the third and fourth heat exchange paths P3, P4 of the second tube group G2 are brazed to a portion of the second header tank 4 located below the first header tank 3. The internal volume of the second header tank 4 is determined such that a portion of gas-liquid mixed phase refrigerant having flowed into the second header tank 4; i.e., liquid-predominant mixed phase refrigerant, accumulates in a lower region within the second header tank 4 because of gravitational force, and the gas phase component of the gas-liquid mixed phase refrigerant accumulates in an upper region within the second header tank 4 because of gravitational force, whereby only the liquid-predominant mixed phase refrigerant flows into the second heat exchange tubes 2B of the fourth heat exchange path P4. Accordingly, the second header tank 4 functions as a liquid receiver which separates gas and liquid from each other by making use of the gravitational force and stores the liquid.

The third header tank 5 is disposed at the right end of the condenser 1, and all the heat exchange tubes 2A, 2B which form the first and second heat exchange paths P1, P2 of the first tube group G1 and the third and fourth heat exchange paths P3, P4 of the second tube group G2 are connected to the third header tank 5. Accordingly, the right ends of all the heat exchange tubes 2A, 2B are located at approximately the same position.

The interior of the third header tank 5 is divided into an upper header section 11, an intermediate header section 12, and a lower header section 13 by aluminum partition plates 8, 9, which are provided at a height between the first heat exchange path P1 and the second heat exchange path P2 and a height between the third heat exchange path P3 and the fourth heat exchange path P4, respectively.

A refrigerant inlet 14 is formed at the upper header section 11 of the third header tank 5, and a refrigerant outlet 15 is formed at the lower header section 13 of the third header tank 5. Thus, as described above, refrigerant flows from the first heat exchange path P1 at the upper end toward the second heat exchange path P2 at the lower end in the first tube group G1, flows from the third heat exchange path P3 at the upper end toward the fourth heat exchange path P4 at the lower end in the second tube group G2. The refrigerant having flowed through the two heat exchange paths P1, P2 of the first tube group G1 flows through the two heat exchange paths P3, P4 of the second tube group G2. A refrigerant inlet member 16 which communicates with the refrigerant inlet 14 and a refrigerant outlet member 17 which communicates with the refrigerant outlet 15 are joined to the third header tank 5.

The first header tank 3, a portion of the second header tank 4 to which the second heat exchange tubes 2B of the third heat exchange path P3 are connected, the upper and intermediate header sections 11 and 12 of the third header tank 5, and the first to third heat exchange paths P1-P3 form a condensation section 1A, which condenses refrigerant. A portion of the second header tank 4 to which the second heat exchange tubes 2B of the fourth heat exchange path P4 are connected, the lower header section 13 of the third header tank 5, and the fourth heat exchange path P4 form a subcooling section 1B, which sub-cools refrigerant. Each of the first and second heat exchange paths P1, P2 of the first tube group G1 and the upper end third heat exchange path P3 of the second tube group G2 serves as a refrigerant condensation path for condensing refrigerant, and the lower end fourth heat exchange path P4 of the second tube group G2 serves as a refrigerant subcooling path for sub-cooling refrigerant.

Corrugated fins which are smaller in length in the left-right direction; i.e., corrugated fins 6A each disposed between adjacent first heat exchange tubes 2A of the first tube group G1 will be referred to as first corrugated fins. Corrugated fins which are larger in length in the left-right direction; i.e., corrugated fins 6B each disposed between adjacent second heat exchange tubes 2B of the second tube group G2 will be referred to as second corrugated fins. The corrugated fin 6C disposed on the upper side of the first heat exchange tube 2A at the upper end will be referred to as a third corrugated fin. The corrugated fin 6D disposed on the lower side of the second heat exchange tube 2B at the lower end will be referred to as a fourth corrugated fin. Notably, the first corrugated fin 6A is disposed between the lower end first heat exchange tube 2A of the first tube group G1 and the upper end second heat exchange tube 2B of the second tube group G2. Since the second heat exchange tubes 2B are longer than the first heat exchange tubes 2A, the length of the second corrugated fins 6B in the left-right direction is larger than that of the first corrugated fins 6A. The length of the third corrugated fin 6C in the left-right direction is smaller than the length of the first corrugated fins 6A in the left-right direction. The length of the fourth corrugated fin 6D in the left-right direction is smaller than the length of the second corrugated fins 6B in the left-right direction and larger than the length of the first corrugated fin 6A in the left-right direction. The number of crest portions of each of the first and second corrugated fins 6A, 6B disposed between adjacent heat exchange tubes 2A, 2B falls within a range of a designed number (standard number) ±2. The pitch between adjacent crest portions of each first corrugated fin 6A is smaller than the pitch between adjacent crest portions of each second corrugated fin 6B. The number of crest portions of each of the third and fourth corrugated fins 6C, 6D falls within a range of a designed number (standard number) ±2. The pitch between adjacent crest portions of the third corrugated fin 6C is smaller than the pitch between adjacent crest portions of each first corrugated fin 6A, and the pitch between adjacent crest portions of the fourth corrugated fin 6D is smaller than the pitch between adjacent crest portions of each second corrugated fin 6B.

The first and second corrugated fins 6A, 6B are corrugated fins of one type which are designed and manufactured under the same condition. Two cases exist; i.e., the case where the second corrugated fins 6B suited for the length of the longer second heat exchange tubes 2B are prepared from the first corrugated fins 6A of one type which are designed and manufactured under the condition suitable for the length of the shorter first heat exchange tubes 2A; and the case where the first corrugated fins 6A suited for the length of the shorter first heat exchange tubes 2A are prepared from the second corrugated fins 6B of one type which are designed and manufactured under the condition suitable for the length of the longer second heat exchange tubes 2B. Notably, as to the third and the fourth corrugated fins 6C, 6D, like the above-described case, there exist the case where they are prepared from the first corrugated fins 6A of one type and the case where they are prepared from the second corrugated fins 6B of one type.

Figure 3:
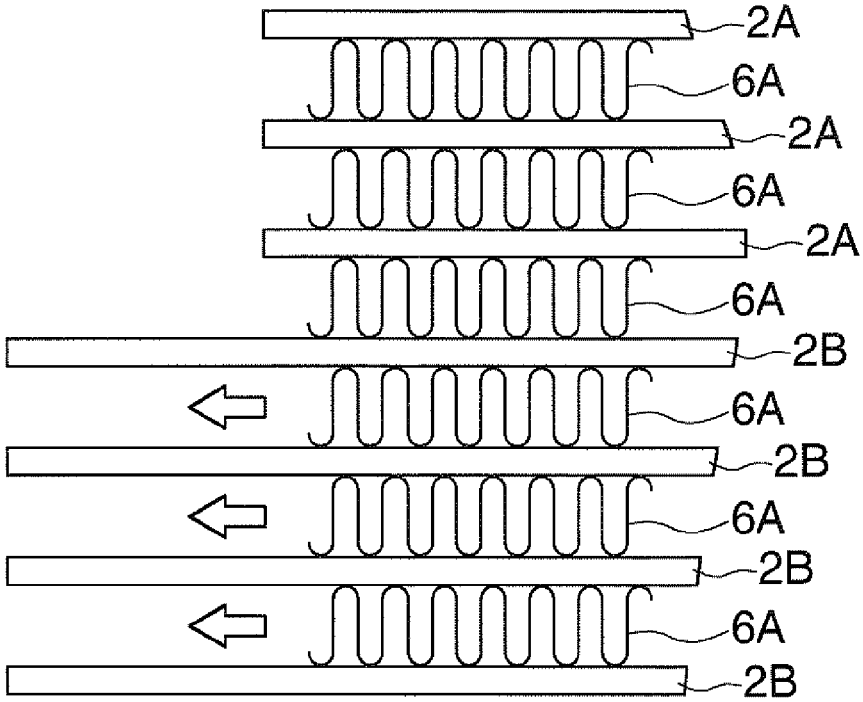
FIG. 3 is a view showing a method of disposing two types of corrugated fins of the condenser of FIG. 1 between adjacent heat exchange tubes and showing a state in which corrugated fins of the same type designed and manufactured for shorter heat exchange tubes are disposed between adjacent heat exchange tubes.
Figure 4:
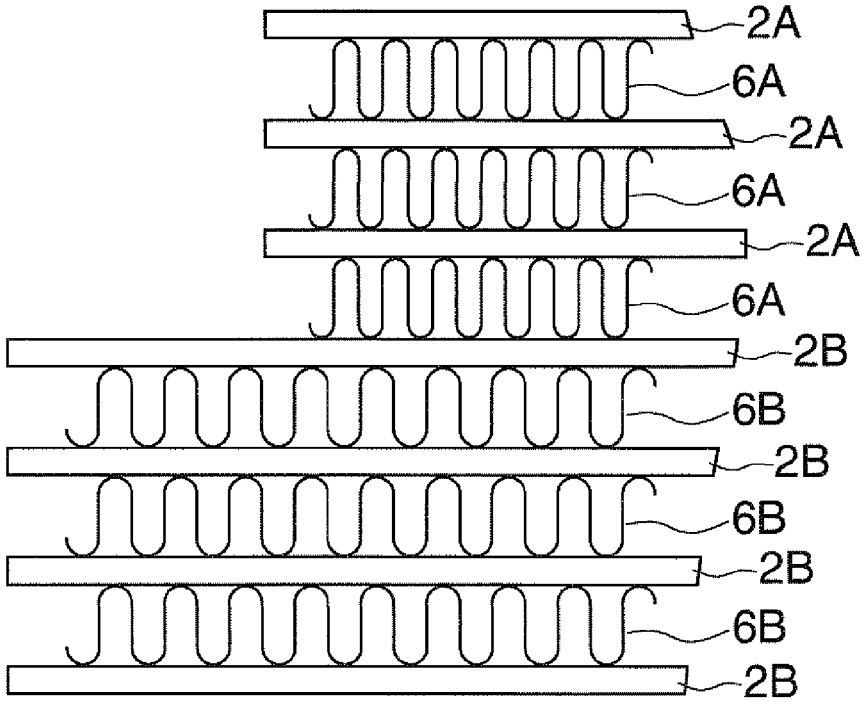
FIG. 4 is a view showing a state in which the corrugated fins disposed between adjacent longer heat exchange tubes shown in FIG. 3 have been stretched.

In the case of using the first corrugated fins 6A designed and manufactured under the condition suitable for the length of the shorter first heat exchange tubes 2A, as shown in FIG. 3, each of the first corrugated fins 6A is first disposed between adjacent first heat exchange tubes 2A, between adjacent second heat exchange tubes 2B, or between the lower end first heat exchange tube 2A and the upper end second heat exchange tube 2B. At that time, the right ends of the heat exchange tubes 2A, 2B are located at substantially the same position, and the right ends of the first corrugated fins 6A are also located at substantially the same position. Subsequently, as shown in FIG. 4, each first corrugated fin 6A disposed between adjacent second heat exchange tubes 2B is stretched such that its left end reaches a position near the left ends of the second heat exchange tubes 2B, whereby the pitch between adjacent crest portions of the first corrugated fins 6A is rendered larger than that before the first corrugated fins 6A are stretched. In this manner, the second corrugated fins 6B are prepared from the first corrugated fins 6A. Notably, the third and fourth corrugated fins 6C, 6D are also prepared from the first corrugated fins 6A in a manner similar to that described above.

Figure 5:
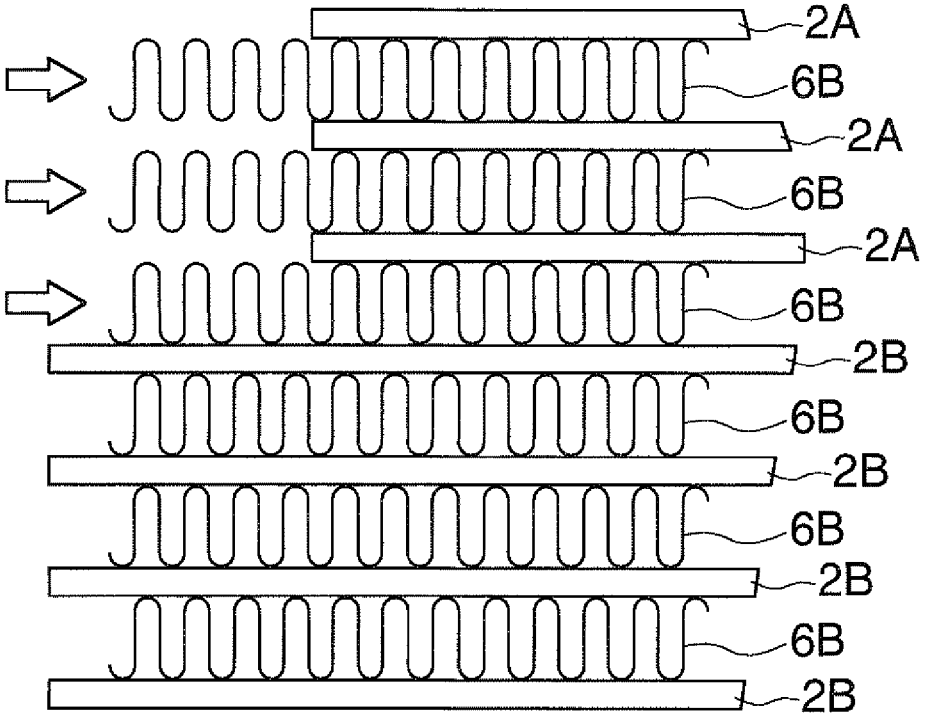
FIG. 5 is a view showing a method of disposing two types of corrugated fins of the condenser of FIG. 1 between adjacent heat exchange tubes and showing a state in which corrugated fins of the same type designed and manufactured for longer heat exchange tubes are disposed between adjacent heat exchange tubes.
Figure 6:
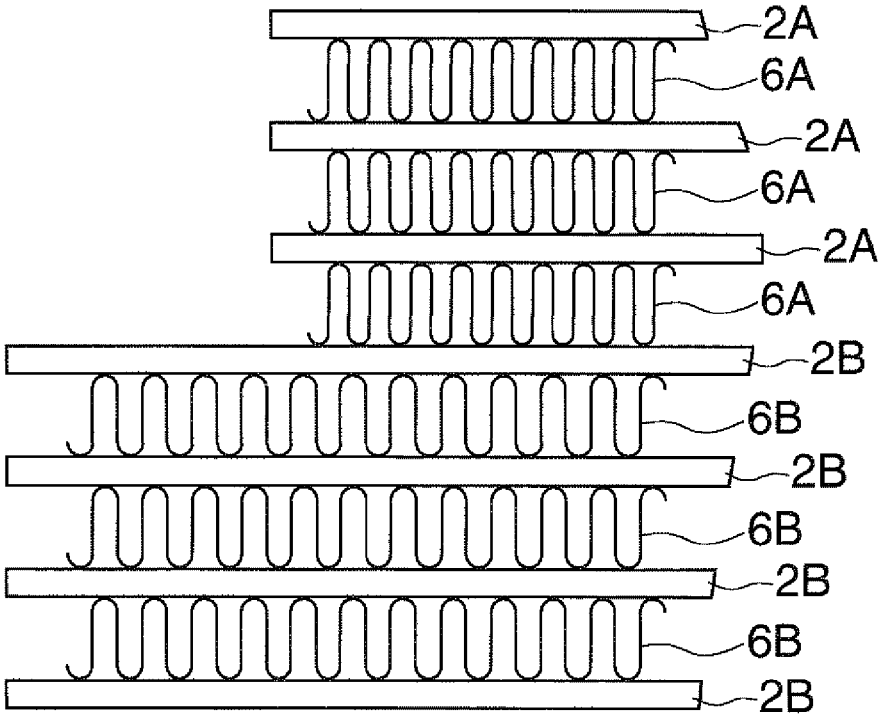
FIG. 6 is a view showing a state in which the corrugated fins disposed between adjacent shorter heat exchange tubes shown in FIG. 5 have been shrunk.

In the case of using the second corrugated fins 6B designed and manufactured under the condition suitable for the length of the longer second heat exchange tubes 2B, as shown in FIG. 5, each of the second corrugated fins 6B is first disposed between adjacent first heat exchange tubes 2A, between adjacent second heat exchange tubes 2B, or between the lower end first heat exchange tube 2A and the upper end second heat exchange tube 2B. At that time, the right ends of the heat exchange tubes 2A, 2B are located at substantially the same position, and the right ends of the second corrugated fins 6B are also located at substantially the same position. Subsequently, as shown in FIG. 6, each second corrugated fin 6B disposed between adjacent first heat exchange tubes 2A and the second corrugated fin 6B disposed between the lower end first heat exchange tube 2A and the upper end second heat exchange tube 2B are compressed rightward such that their left ends reach a position near the left ends of the first heat exchange tubes 2A, whereby the pitch between adjacent crest portions of the second corrugated fins 6B is rendered smaller than that before the second corrugated fins 6B are compressed. In this manner, the first corrugated fins 6A are prepared from the second corrugated fins 6B. Notably, the third and fourth corrugated fins 6C, 6D are also prepared from the second corrugated fins 6B in a manner similar to that described above.

The condenser 1 is manufactured by brazing all the components together.

The condenser 1 constitutes a refrigeration cycle in cooperation with a compressor, an expansion valve (pressure reducer), and an evaporator; and the refrigeration cycle is mounted on a vehicle as a car air conditioner.

In the condenser 1 having the above-described structure, gas phase refrigerant of high temperature and high pressure compressed by the compressor flows into the upper header section 11 of the third header tank 5 via the refrigerant inlet member 16 and the refrigerant inlet 14. The gas phase refrigerant is condensed while flowing leftward within the first heat exchange tubes 2A of the first heat exchange path P1, and then flows into the first header tank 3. The refrigerant having flowed into the first header tank 3 is condensed while flowing rightward within the first heat exchange tubes 2A of the second heat exchange path P2, and then flows into the intermediate header section 12 of the third header tank 5. The refrigerant having flowed into the intermediate header section 12 of the third header tank 5 is condensed while flowing leftward within the second heat exchange tubes 2B of the third heat exchange path P3, and then flows into the second header tank 4.

The refrigerant having flowed into the second header tank 4 is gas-liquid mixed phase refrigerant. A portion of the gas-liquid mixed phase refrigerant; i.e., liquid-predominant mixed phase refrigerant, accumulates in a lower region within the second header tank 4 because of gravitational force, and enters the second heat exchange tubes 2B of the fourth heat exchange path P4.

The liquid-predominant mixed phase refrigerant having entered the second heat exchange tubes 2B of the fourth heat exchange path P4 is sub-cooled while flowing rightward within the second heat exchange tubes 2B. After that, the sub-cooled refrigerant enters the lower header section 13 of the third header tank 5, and flows out via the refrigerant outlet 15 and the refrigerant outlet member 17. The refrigerant is then fed to the evaporator via the expansion valve.

Meanwhile, the gas phase component of the gas-liquid mixed phase refrigerant having flowed into the second header tank 4 accumulates in an upper region within the second header tank 4.

Figure 7:
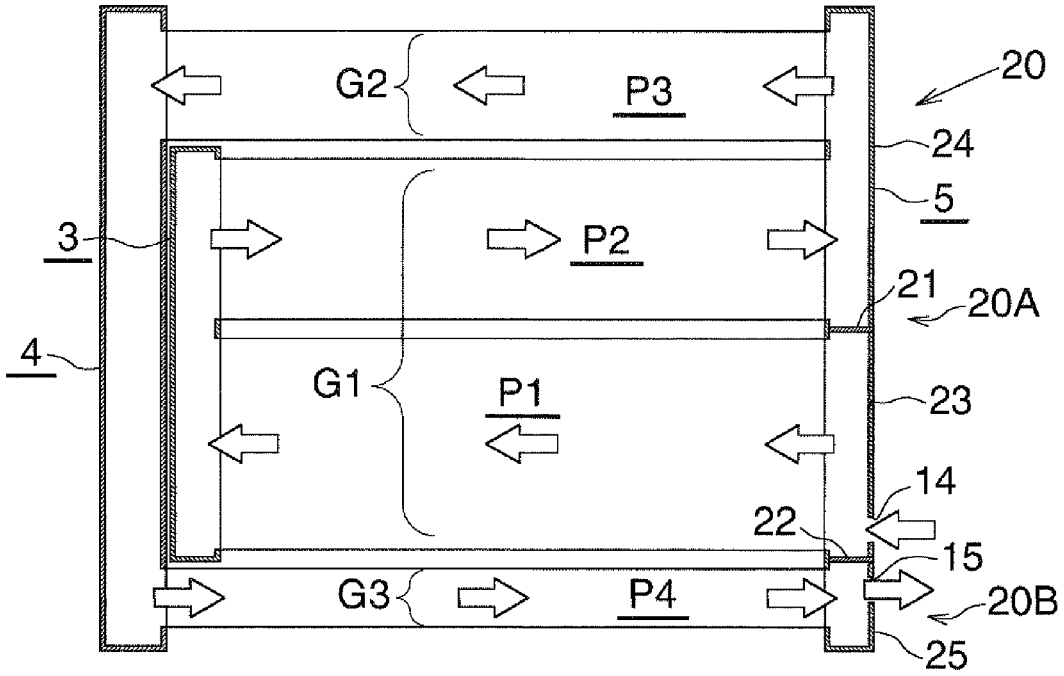
FIG. 7 is a front view schematically showing a condenser to which a heat exchanger according to a second embodiment is applied.
Figure 8:
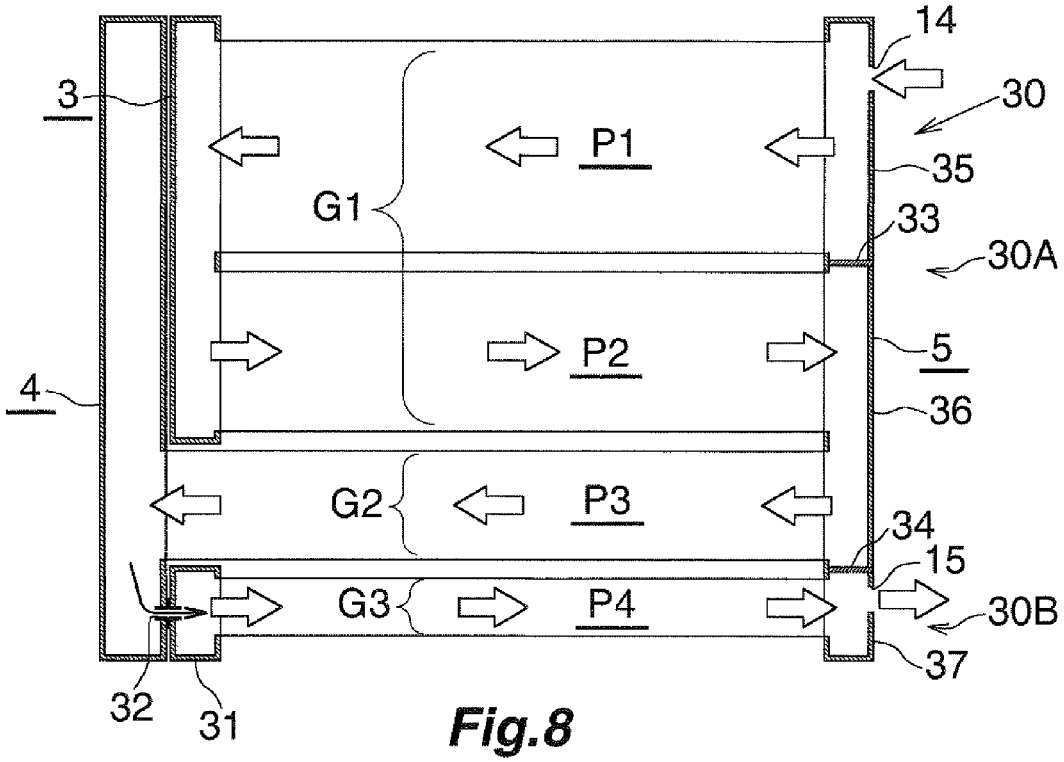
FIG. 8 is a front view schematically showing a condenser to which a heat exchanger according to a third embodiment is applied.

FIGS. 7 and 8 show the condenser to which the heat exchanger of the other embodiment is applied. In FIGS. 7 and 8, each of which schematically shows a condenser, individual heat exchange tubes are not illustrated, and corrugated fins, side plates, a refrigerant inlet member, and a refrigerant outlet member are also not illustrated.

In the case of the condenser 20 shown in FIG. 7, four heat exchange paths P1, P2, P3, P4 each formed by a plurality of heat exchange tubes 2A, 2B successively arranged in the vertical direction are juxtaposed in the vertical direction. The three heat exchange paths on the upper side will be referred to as the first through third heat exchange paths P1, P2, P3 from the lower side, and the heat exchange path at the lower end will be referred to as the fourth heat exchange paths P4. The flow direction of refrigerant is the same among all the heat exchange tubes 2A, 2B which form the respective heat exchange paths P1, P2, P3, P4. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path. The first and second heat exchange paths P1, P2 are formed by the first heat exchange tubes 2A of the same type which have the same length. The third and fourth heat exchange paths P3, P4 are formed by the second heat exchange tubes 2B of the same type which have the same length.

Namely, the condenser 20 has a first tube group G1 composed of the first and second heat exchange paths P1, P2; a second tube group G2 provided above the first tube group G1 and composed of the third heat exchange path P3 at the upper end; and a third tube group G3 provided below the first tube group G1 and composed of the fourth heat exchange path P4 at the lower end. The second heat exchange tubes 2B of the second and third tube groups G2, G3 are greater in length than the first heat exchange tubes 2A of the first tube group G1. In the first tube group G1, refrigerant is caused to flow from the first heat exchange path P1 at the lower end toward the second heat exchange path P2 at the upper end. The refrigerant having flowed through the two heat exchange paths P1, P2 of the first tube group G1 is caused to flow through the third heat exchange path P3 of the second tube group G2 and the fourth heat exchange path P4 of the third tube group G3 in this order.

A first header tank 3 and a second header tank 4 are individually provided at the left end of the condenser 20. The first heat exchange tubes 2A of the first and second heat exchange paths P1, P2 of the first tube group G1 are connected to the first header tank 3 by means of brazing. The second heat exchange tubes 2B of the third and fourth heat exchange paths P3, P4 of the second and third tube groups G2, G3 are connected to the second header tank 4 by means of brazing. The second header tank 4 is disposed on the outer side (left side) of the first header tank 3 with respect to the left-right direction. The upper end of the second header tank 4 disposed at the left end of the condenser 20 is located above the upper end of the first header tank 3, and the lower end of the second header tank 4 is located below the lower end of the first header tank 3. The first heat exchange tubes 2A of the first and second heat exchange paths P1, P2 of the first tube group G1 are brazed to the first header tank 3. The second heat exchange tubes 2B of the third heat exchange path P3 of the second tube group G2 are brazed to a portion of the second header tank 4 located above the first header tank 3. The second heat exchange tubes 2B of the fourth heat exchange path P4 of the third tube group G3 are brazed to a portion of the second header tank 4 located below the first header tank 3.

The internal volume of the second header tank 4 is determined such that a portion of gas-liquid mixed phase refrigerant having flowed into the second header tank 4; i.e., liquid-predominant mixed phase refrigerant, accumulates in a lower region within the second header tank 4 because of gravitational force, and the gas phase component of the gas-liquid mixed phase refrigerant accumulates in an upper region within the second header tank 4 because of gravitational force, whereby only the liquid-predominant mixed phase refrigerant flows into the second heat exchange tubes 2B of the fourth heat exchange path P4. Accordingly, the second header tank 4 functions as a liquid receiver which separates gas and liquid from each other by making use of the gravitational force and stores the liquid.

The interior of a third header tank 5 to which the right ends of all the heat exchange tubes 2A, 2B are connected by means of brazing is divided into an intermediate header section 23, an upper header section 24, and a lower header section 25 by aluminum partition plates 21, 22, which are provided at a height between the first heat exchange path P1 and the second heat exchange path P2 and a height between the first heat exchange path P1 and the fourth heat exchange path P4, respectively. A refrigerant inlet 14 is formed at the lower end of the intermediate header section 23 of the third header tank 5, and a refrigerant outlet 15 is formed at the lower header section 25 of the third header tank 5. The right ends of the first heat exchange tubes 2A of the first heat exchange path P1 are connected to the intermediate header section 23 of the third header tank 5. The right ends of the first heat exchange tubes 2A of the second heat exchange path P2 are connected to the upper header section 24 of the third header tank 5. The right ends of the second heat exchange tubes 2B of the third heat exchange path P3 are connected to the upper header section 24 of the third header tank 5. The right ends of the second heat exchange tubes 2B of the fourth heat exchange path P4 are connected to the lower header section 25 of the third header tank 5. A refrigerant inlet member (not shown) which communicates with the refrigerant inlet 14 and a refrigerant outlet member (not shown) which communicates with the refrigerant outlet 15 are joined to the third header tank 5.

The first header tank 3, a portion of the second header tank 4 to which the second heat exchange tubes 2B of the third heat exchange path P3 are connected, the intermediate and upper header sections 23, 24 of the third header tank 5, and the first to third heat exchange paths P1-P3 form a condensation section 20A, which condenses refrigerant. A portion of the second header tank 4 to which the second heat exchange tubes 2B of the fourth heat exchange path P4 are connected, the lower header section 25 of the third header tank 5, and the fourth heat exchange path P4 form a subcooling section 20B, which sub-cools refrigerant. Each of the first and second heat exchange paths P1, P2 of the first tube group G1 and the upper end third heat exchange path P3 of the second tube group G2 serves as a refrigerant condensation path for condensing refrigerant, and the fourth heat exchange path P4 of the third tube group G3 serves as a refrigerant subcooling path for sub-cooling refrigerant.

Although not illustrated in the drawings, first corrugated fins 6A which are smaller in length in the left-right direction are disposed between adjacent first heat exchange tubes 2A of the first tube group G1, between the upper end first heat exchange tube 2A of the first tube group G1 and the lower end second heat exchange tube 2B of the second tube group G2, and between the lower end first heat exchange tube 2A of the first tube group G1 and the upper end second heat exchange tube 2B of the third tube group G3. Also, second corrugated fins 6B which are larger in length in the left-right direction are disposed between adjacent second heat exchange tubes 2B of the second and third tube groups G2, G3. The number of crest portions of each of all the first and second corrugated fins 6A, 6B falls within the range of a designed number (standard number) ±2. The pitch between adjacent crest portions of each first corrugated fin 6A is smaller than the pitch between adjacent crest portions of each second corrugated fin 6B. As in the case of the above-described first embodiment, the first and second corrugated fins 6A, 6B are corrugated fins of one type which are designed and manufactured under the same condition.

Notably, in the case of the condenser 20 shown in FIG. 7, the fourth corrugated fin 6D of the condenser 1 of the first embodiment is disposed on the upper side of the upper end second heat exchange tube 2B and on the lower side of the lower end second heat exchange tube 2B.

The remaining structure is identical to that of the condenser shown in FIGS. 1 and 2.

In the condenser 20 shown in FIG. 7, gas phase refrigerant of high temperature and high pressure compressed by the compressor flows into the intermediate header section 23 of the third header tank 5 via the refrigerant inlet member and the refrigerant inlet 14. The gas phase refrigerant is condensed while flowing leftward within the first heat exchange tubes 2A of the first heat exchange path P1, and then flows into the first header tank 3. The refrigerant having flowed into the first header tank 3 is condensed while flowing rightward within the first heat exchange tubes 2A of the second heat exchange path P2, and then flows into the upper header section 24 of the third header tank 5. The refrigerant having flowed into the upper header section 24 of the third header tank 5 is condensed while flowing leftward within the second heat exchange tubes 2B of the third heat exchange path P3, and then flows into the second header tank 4.

The refrigerant having flowed into the second header tank 4 is gas-liquid mixed phase refrigerant. A portion of the gas-liquid mixed phase refrigerant; i.e., liquid-predominant mixed phase refrigerant, accumulates in a lower region within the second header tank 4 because of gravitational force, and enters the second heat exchange tubes 2B of the fourth heat exchange path P4. The liquid-predominant mixed phase refrigerant having entered the second heat exchange tubes 2B of the fourth heat exchange path P4 is sub-cooled while flowing rightward within the second heat exchange tubes 2B. After that, the sub-cooled refrigerant enters the lower header section 25 of the third header tank 5, and flows out via the refrigerant outlet 15 and the refrigerant outlet member. The refrigerant is then fed to the evaporator via the expansion valve.

Meanwhile, the gas phase component of the gas-liquid mixed phase refrigerant having flowed into the second header tank 4 accumulates in an upper region within the second header tank 4.

In the case of the condenser 30 shown in FIG. 8, four heat exchange paths P1, P2, P3, P4 each formed by a plurality of heat exchange tubes 2A, 2B successively arranged in the vertical direction are juxtaposed in the vertical direction. The four heat exchange paths will be referred to as the first through fourth heat exchange paths P1, P2, P3, P4 from the upper side. The flow direction of refrigerant is the same among all the heat exchange tubes 2A, 2B which form the respective heat exchange paths P1, P2, P3, P4. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path. The first, second, and fourth heat exchange paths P1, P2, P4 are formed by the first heat exchange tubes 2A of the same type which have the same length. The third heat exchange path P3 is formed by the second heat exchange tubes 2B of the same type which have the same length.

Namely, the condenser 30 has a first tube group G1 composed of at least one heat exchange path, including the upper end first heat exchange paths P1, (in the present embodiment, two heat exchange paths; i.e., the first and second heat exchange paths P1, P2); a second tube group G2 provided below the first tube group G1 and composed of the third heat exchange path P3; and a third tube group G3 provided below the second tube group G2 and composed of the fourth heat exchange path P4 at the lower end. The second heat exchange tubes 2B of the second tube group G2 are greater in length than the first heat exchange tubes 2A of the first and third tube groups G1, G3. In the first tube group G1, refrigerant is caused to flow from the first heat exchange path P1 at the upper end toward the second heat exchange path P2 at the lower end. The refrigerant having flowed through the two heat exchange paths P1, P2 of the first tube group G1 is caused to flow through the third heat exchange path P3 of the second tube group G2 and the fourth heat exchange path P4 of the third tube group G3 in this order.

A first header tank 3, a second header tank 4, and a third header tank 31 are individually provided at the left end of the condenser 30. The first heat exchange tubes 2A of the first and second heat exchange paths P1, P2 of the first tube group G1 are connected to the first header tank 3 by means of brazing. The second heat exchange tubes 2B of the third heat exchange path P3 of the second tube group G2 are connected to the second header tank 4 by means of brazing. The first heat exchange tubes 2A of the fourth heat exchange path P4 of the third tube group G3 are connected to the third header tank 31 by means of brazing. The second header tank 4 is disposed on the outer side (left side) of the first and third header tanks 3, 31 with respect to the left-right direction. The upper end of the second header tank 4 disposed at the left end of the condenser 30 is located above the lower end of the first header tank 3, and the lower end of the second header tank 4 is located below the upper end of the third header tank 31. The first heat exchange tubes 2A of the first and second heat exchange paths P1, P2 of the first tube group G1 are brazed to the first header tank 3. The second heat exchange tubes 2B of the third heat exchange path P3 of the second tube group G2 are brazed to the second header tank 4. The second heat exchange tubes 2B of the fourth heat exchange path P4 of the third tube group G3 are brazed to the third header tank 31. The second header tank 4 and the third header tank 31 communicate with each other through a communication member 32.

The internal volume of the second header tank 4 is determined such that a portion of gas-liquid mixed phase refrigerant having flowed into the second header tank 4; i.e., liquid-predominant mixed phase refrigerant, accumulates in a lower region within the second header tank 4 because of gravitational force, and the gas phase component of the gas-liquid mixed phase refrigerant accumulates in an upper region within the second header tank 4 because of gravitational force, whereby only the liquid-predominant mixed phase refrigerant flows into the second heat exchange tubes 2B of the fourth heat exchange path P4. Accordingly, the second header tank 4 functions as a liquid receiver which separates gas and liquid from each other by making use of the gravitational force and stores the liquid.

The interior of a fourth header tank 5 to which the right ends of all the heat exchange tubes 2A, 2B are connected by means of brazing is divided into an upper header section 35, an intermediate header section 36, and a lower header section 37 by aluminum partition plates 33, 34, which are provided at a height between the first heat exchange path P1 and the second heat exchange path P2 and a height between the third heat exchange path P3 and the fourth heat exchange path P4, respectively. A refrigerant inlet 14 is formed at the upper end of the upper header section 35 of the fourth header tank 5, and a refrigerant outlet 15 is formed at the lower header section 37 of the fourth header tank 5. The right ends of the first heat exchange tubes 2A of the first heat exchange path P1 are connected to the upper header section 35 of the fourth header tank 5. The right ends of the first heat exchange tubes 2A of the second heat exchange path P2 are connected to the intermediate header section 36 of the fourth header tank 5. The right ends of the second heat exchange tubes 2B of the third heat exchange path P3 are connected to the intermediate header section 36 of the fourth header tank 5. The right ends of the second heat exchange tubes 2B of the fourth heat exchange path P4 are connected to the lower header section 37 of the fourth header tank 5. A refrigerant inlet member (not shown) which communicates with the refrigerant inlet 14 and a refrigerant outlet member (not shown) which communicates with the refrigerant outlet 15 are joined to the fourth header tank 5.

The first header tank 3, the second header tank 4, the upper and intermediate header sections 35, 36 of the fourth header tank 5, and the first to third heat exchange paths P1-P3 form a condensation section 30A, which condenses refrigerant. The third header tank 31, the lower header section 37 of the fourth header tank 5, and the fourth heat exchange path P4 form a subcooling section 30B, which sub-cools refrigerant. Each of the first and second heat exchange paths P1, P2 of the first tube group G1 and the third heat exchange path P3 of the second tube group G2 serves as a refrigerant condensation path for condensing refrigerant, and the fourth heat exchange path P4 of the third tube group G3 serves as a refrigerant subcooling path for sub-cooling refrigerant.

Although not illustrated in the drawings, first corrugated fins 6A which are smaller in length in the left-right direction are disposed between adjacent first heat exchange tubes 2A of the first and third tube groups G1, G3, between the lower end first heat exchange tube 2A of the first tube group G1 and the upper end second heat exchange tube 2B of the second tube group G2, and between the lower end second heat exchange tube 2B of the second tube group G2 and the upper end first heat exchange tube 2A of the third tube group G3. Also, second corrugated fins 6B which are larger in length in the left-right direction are disposed between adjacent second heat exchange tubes 2B of the second tube group G2. The number of crest portions of each of all the first and second corrugated fins 6A, 6B falls within the range of a designed number (standard number) ±2. The pitch between adjacent crest portions of each first corrugated fin 6A is smaller than the pitch between adjacent crest portions of each second corrugated fin 6B. As in the case of the above-described first embodiment, the first and second corrugated fins 6A, 6B are corrugated fins of one type which are designed and manufactured under the same condition.

Notably, in the case of the condenser 30 shown in FIG. 8, the third corrugated fin 6C of the condenser 1 of the first embodiment is disposed on the upper side of the upper end first heat exchange tube 2A and on the lower side of the lower end first heat exchange tube 2A.

The remaining structure is identical to that of the condenser shown in FIGS. 1 and 2.

In the condenser 30 shown in FIG. 8, gas phase refrigerant of high temperature and high pressure compressed by the compressor flows into the upper header section 35 of the fourth header tank 5 via the refrigerant inlet member and the refrigerant inlet 14. The gas phase refrigerant is condensed while flowing leftward within the first heat exchange tubes 2A of the first heat exchange path P1, and then flows into the first header tank 3. The refrigerant having flowed into the first header tank 3 is condensed while flowing rightward within the first heat exchange tubes 2A of the second heat exchange path P2, and then flows into the intermediate header section 36 of the fourth header tank 5. The refrigerant having flowed into the intermediate header section 36 of the fourth header tank 5 is condensed while flowing leftward within the second heat exchange tubes 2B of the third heat exchange path P3, and then flows into the second header tank 4.

The refrigerant having flowed into the second header tank 4 is gas-liquid mixed phase refrigerant. A portion of the gas-liquid mixed phase refrigerant; i.e., liquid-predominant mixed phase refrigerant, accumulates in a lower region within the second header tank 4 because of gravitational force, and enters the third header tank 31 through the communication member 32. The liquid-predominant mixed phase refrigerant having entered the third header tank 31 is sub-cooled while flowing rightward within the first heat exchange tubes 2A of the fourth heat exchange path P4 After that, the sub-cooled refrigerant enters the lower header section 37 of the fourth header tank 5, and flows out via the refrigerant outlet 15 and the refrigerant outlet member. The refrigerant is then fed to the evaporator via the expansion valve.

Meanwhile, the gas phase component of the gas-liquid mixed phase refrigerant having flowed into the second header tank 4 accumulates in an upper region within the second header tank 4.

In the condensers 1, 20, 30 shown in FIGS. 1, 2, 7, and 8, a desiccant and/or a filter may be disposed within the second header tank 4.

1) A heat exchanger including a plurality of types of heat exchange tubes which differ in length and which are disposed such that their longitudinal direction coincides with a left-right direction and they are spaced apart from one another in a vertical direction; and corrugated fins each disposed between adjacent heat exchange tubes and having crest portions extending in an air passage direction, trough portions extending in the air passage direction, and connection portions connecting the crest portions and the trough portions, wherein the number of the crest portions of each corrugated fin disposed between adjacent heat exchange tubes falls within a range of a designed number ±2, the designed number being a standard number.

2) A heat exchanger according to par. 1), which includes a plurality of tube groups each of which is formed by successively arranging in the vertical direction heat exchange tubes of the same type having the same length, wherein the heat exchange tubes of one of at least two tube groups differ in length from the heat exchange tubes of the other tube group; the two tube groups formed by the heat exchange tubes which differ in length are disposed such that they are adjacent to each other in the vertical direction; the corrugated fins each disposed between longer heat exchange tubes have a length in the left-right direction greater than that of the corrugated fins each disposed between shorter heat exchange tubes.

3) A heat exchanger according to par. 2), further including header tanks which are disposed such that their longitudinal direction coincides with the vertical direction and to which left and right ends of the heat exchange tubes are connected; two or more heat exchange paths each of which is formed by a plurality of heat exchange tubes successively arranged in the vertical direction and which are juxtaposed in the vertical direction; and a first tube group composed of at least one heat exchange path including the heat exchange path at the upper end, and a second tube group provided below the first tube group and composed of at least one heat exchange path including the heat exchange path at the lower end, the length of the heat exchange tubes of the second tube group being larger than the length of the heat exchange tubes of the first tube group, wherein the header tanks include first and second header tanks provided at the left or right end of the heat exchanger, the heat exchange tubes which form the heat exchange path of the first tube group being connected to the first header tank, and the heat exchange tubes which form the heat exchange path of the second tube group being connected to the second header tank; the second header tank is disposed on the outer side of the first header tank with respect to the left-right direction; and the upper end of the second header tank is located above the lower end of the first header tank.

4) A heat exchanger according to par. 3), wherein each of the first tube group and the second tube group includes two or more heat exchange paths; in each of the first tube group and the second tube group, refrigerant is caused to flow from the heat exchange path at the upper end toward the heat exchange path at the lower end; the refrigerant is caused to flow through the heat exchange paths of the second tube group after having flowed through the heat exchange paths of the first tube group; the second header tank has a function of separating gas and liquid from each other and storing the separated liquid; and the heat exchange paths of the first tube group and the upper end heat exchange path of the second tube group serve as refrigerant condensation paths, and the remaining heat exchange path of the second tube group serves as a refrigerant subcooling path.

5) A heat exchanger according to par. 2), further including header tanks which are disposed such that their longitudinal direction coincides with the vertical direction and to which left and right ends of the heat exchange tubes are connected; three or more heat exchange paths each of which is formed by a plurality of heat exchange tubes successively arranged in the vertical direction and which are juxtaposed in the vertical direction; and a first tube group composed of at least two heat exchange paths, a second tube group provided above the first tube group and composed of the heat exchange path at the upper end, and a third tube group provided below the first tube group and composed of the heat exchange path at the lower end, the length of the heat exchange tubes of the second and third tube groups being larger than the length of the heat exchange tubes of the first tube group, and the length of the heat exchange tubes of the second tube group being equal to the length of the heat exchange tubes of the third tube group, wherein the header tanks include first and second header tanks provided at the left or right end of the heat exchanger, the heat exchange tubes which form the heat exchange paths of the first tube group being connected to the first header tank, and the heat exchange tubes which form the heat exchange paths of the second and third tube groups being connected to the second header tank; the second header tank is disposed on the outer side of the first header tank with respect to the left-right direction; and the upper and lower ends of the second header tank are located outward of the upper and lower ends of the first header tank with respect to the vertical direction.

6) A heat exchanger according to par. 5), wherein in the first tube group, refrigerant is caused to flow from the heat exchange path at the lower end toward the heat exchange path at the upper end; the refrigerant having flowed through the heat exchange paths of the first tube group is caused to flow through the heat exchange path of the second tube group and then flow through the heat exchange path of the third tube group; the second header tank has a function of separating gas and liquid from each other and storing the separated liquid; and the heat exchange paths of the first and second tube groups serve as refrigerant condensation paths, and the heat exchange path of the third tube group serves as a refrigerant subcooling path.

7) A heat exchanger according to par. 2), further including header tanks which are disposed such that their longitudinal direction coincides with the vertical direction and to which left and right ends of the heat exchange tubes are connected; three or more heat exchange paths each of which is formed by a plurality of heat exchange tubes successively arranged in the vertical direction and which are juxtaposed in the vertical direction; and a first tube group composed of at least one heat exchange path, including the heat exchange path at the upper end, a second tube group provided below the first tube group and composed of one heat exchange path, and a third tube group provided below the second tube group and composed of the remaining heat exchange path, the length of the heat exchange tubes of the second tube group being larger than the length of the heat exchange tubes of the first and third tube groups, and the length of the heat exchange tubes of the first tube group being equal to the length of the heat exchange tubes of the third tube group, wherein the header tanks include first, second, third header tanks provided at the left or right end of the heat exchanger, the heat exchange tubes which form the heat exchange path of the first tube group being connected to the first header tank, the heat exchange tubes which form the heat exchange path of the second tube group being connected to the second header tank, and the heat exchange tubes which form the heat exchange path of the third tube group being connected to the third header tank; the second header tank is disposed on the outer side of the first and third header tanks with respect to the left-right direction; the upper end of the second header tank is located above the lower end of the first header tank, and the lower end of the second header tank is located below the upper end of the third header tank; and the second header tank and the third header tank communicate with each other.

8) A heat exchanger according to par. 7), wherein in the first tube group, refrigerant is caused to flow from the heat exchange path at the upper end toward the heat exchange path at the lower end; the refrigerant having flowed through the heat exchange path of the first tube group is caused to flow through the heat exchange path of the second tube group and then flow through the heat exchange path of the third tube group; the second header tank has a function of separating gas and liquid from each other and storing the separated liquid; and the heat exchange paths of the first and second tube groups serve as refrigerant condensation paths, and the heat exchange path of the third tube group serves as a refrigerant subcooling path.

According to the heat exchanger of any of pars. 1) to 8), the number of the crest portions of each corrugated fin disposed between adjacent heat exchange tubes falls within a range of a designed number (standard number) ±2. Therefore, only corrugated fins of one type designed and manufactured under the same condition are required as corrugated fins disposed between the adjacent heat exchange tubes. Accordingly, manufacture of the heat exchanger merely requires disposing corrugated fins of one type between adjacent heat exchange tubes. Therefore, working efficiency is improved.

Namely, in the case of using corrugated fins of one type designed and manufactured under the condition suitable for the shortest heat exchange tubes, after disposing the corrugated fins between all the heat exchange tubes adjacent to one another, the corrugated fins disposed between the longer heat exchange tubes are stretched or expanded such that the corrugated fins extend over the entire length of the longer heat exchange tubes. In contrast, in the case of using corrugated fins of one type designed and manufactured under the condition suitable for the longest heat exchange tubes, after disposing the corrugated fins between all the heat exchange tubes adjacent to one another, the corrugated fins disposed between the shorter heat exchange tubes are shrunk or compressed such that the corrugated fins extend over the entire length of the shorter heat exchange tubes.

In the case where the heat exchanger of any one of pars. 3) to 8) is used as a condenser, in order to effectively perform gas-liquid separation, the internal volume of the second header tank can be increased by, for example, extending the second header tank upward such that its upper end is located near the upper end of the first header tank, without rendering the thickness of the second header tank greater than that of the first header tank. Accordingly, a space for installing the condenser can be made relatively small. Also, since a space is present in the second header tank above a portion to which the heat exchange tubes are connected, an excellent gas-liquid separation effect can be realized by the gravitational force.

In the case where the heat exchanger of par. 7) or 8) is used as a condenser, the following advantageous effect is attained. In the case where refrigerant is charged in such an amount that the degree of subcooling becomes constant, even if the refrigerant flowing from the heat exchange path of the second tube group into the second header tank is in a gas-liquid mixed phase, babbles flow into the second header tank through the heat exchange tube at the upper side of the heat exchange path of the second tube group. Accordingly, the speed at which the refrigerant flows into the second header tank decreases, and the refrigerant gently flows into the second header tank, whereby the gas-liquid separation effect within the second header tank is improved. As a result, bubbles are prevented from flowing into the heat exchange tubes of the heat exchange path of the third tube group, which serves as the refrigerant subcooling path.

Obviously, numerous modifications and variations of the present invention are possible in light of the above teachings. It is therefore to be understood that within the scope of the appended claims, the invention may be practiced otherwise than as specifically described herein.

What is claimed is:

1. A heat exchanger comprising:

first heat exchange tubes having a first length in a longitudinal direction extending between header tanks of the heat exchanger and provided to have first spaces among the first heat exchange tubes;

second heat exchange tubes having a second length in the longitudinal direction and provided to have second spaces among the second heat exchange tubes, the second length being longer than the first length;

first corrugated fins each provided in each of the first spaces to have a first fin length in the longitudinal direction, each of the first corrugated fins including a first total number of first waves formed of a sequential repetition of crest portions and trough portions aligned in the longitudinal direction; and second corrugated fins each provided in each of the second spaces to have a second fin length in the longitudinal direction, each of the second corrugated fins including a second total number of waves formed of a sequential repetition of crest portions and trough portions aligned in the longitudinal direction, the second fin length being longer than the first fin length, a difference between the first total number of waves and the second total number of waves being at most 2.

2. The heat exchanger according to claim 1, wherein the header tanks include a first header tank and a third header tank, the first heat exchange tubes extending between the first header tank and the third header tank in the longitudinal direction and being connected to the first header tank and the third header tank, wherein the second heat exchange tubes extend between a second header tank and the third header tank in the longitudinal direction and are connected to the second header tank and the third header tank, wherein the first header tank, the second header tank, and the third header tank extend in an extending direction substantially perpendicular to the longitudinal direction, wherein the first header tank is provided between the second header tank and the third header tank in the longitudinal direction, and wherein the first header tank and the second header tank overlap in the extending direction.

3. A heat exchanger according to claim 2, wherein refrigerant flows from the first heat exchange tubes to the second heat exchange tubes, and wherein the second header tank is constructed to separate gas and liquid from a mixture and to store the liquid in the second header tank.

* * * * *